US008288642B1

(12) United States Patent
Graham

(10) Patent No.: US 8,288,642 B1
(45) Date of Patent: Oct. 16, 2012

(54) ELECTRIC MUSICAL INSTRUMENT

(76) Inventor: Andy Graham, Santa Rosa, CA (US)

( * ) Notice: Subject to any disclaimer, the term of this patent is extended or adjusted under 35 U.S.C. 154(b) by 0 days.

(21) Appl. No.: 13/423,678

(22) Filed: Mar. 19, 2012

Related U.S. Application Data

(63) Continuation-in-part of application No. 29/388,003, filed on Mar. 22, 2011.

(60) Provisional application No. 61/551,278, filed on Oct. 25, 2011.

(51) Int. Cl.
*G10H 1/32* (2006.01)
*G10H 3/00* (2006.01)

(52) U.S. Cl. ..... 84/743; 84/725; 84/410

(58) Field of Classification Search ..... 84/725, 84/743, 294, 408–410
See application file for complete search history.

(56) References Cited

U.S. PATENT DOCUMENTS 4,167,133 A * 9/1979 Adams, Jr. ..... 84/293
5,263,838 A * 11/1993 Meuser et al. ..... 224/191
5,602,354 A * 2/1997 Martin ..... 84/410
6,011,206 A * 1/2000 Straley ..... 84/402

OTHER PUBLICATIONS

Whamola—Wikipedia(R), the free encyclopedia, article retrieved from http://en.wikipedia.org/wiki/Whamola on Jul. 8, 2008, is admitted prior art for the content of showing a Whamola device.
Washtub bass—Wikipedia(R), the free encyclopedia, article retrieved from http://en.wikipedia.org/wiki/Washtub_bass on Jul. 8, 2008, is admitted prior art for the content showing a Washtub bass device.

* cited by examiner

*Primary Examiner* — Jeffrey Donels
(74) *Attorney, Agent, or Firm* — Edward S. Sherman

(57) ABSTRACT

An electric musical instrument deploys a strap that is tensioned and spaced away from an elongated supporting member generally having a flat face or strap support that extends below the plane of the strap. The instrument is generally played by slapping, tapping or drumming on the strap to causing it to vibrate. When a flat metal strap is deployed, the vibrations are detected by a magnetic transducer or "pick up" generally disposed within the supporting members and converted to sound by conventional audio amplification.

20 Claims, 7 Drawing Sheets

ELECTRIC MUSICAL INSTRUMENT

CROSS REFERENCE TO RELATED APPLICATIONS

The present application is a continuation-in-part and claims the benefit of priority to the US design patent application of the same title that was filed on Mar. 22, 2011, having application Ser. No. 29/388,003, and is incorporated herein by reference.

The present application also claims the benefit of priority to the US Provisional patent application of the same title that was filed on Oct. 25, 2011, having application Ser. No. 61/551,278, and is incorporated herein by reference.

BACKGROUND OF INVENTION

The present invention relates to an Electric Musical Instrument that is optionally played as a string instrument or drum, as well as combined modalities thereof.

It is a first object of the present invention to provide a musical instrument that could produce a unique and pleasing sound.

It is another object of the present invention to provide a musical instrument that is also easy to play.

It is a still further object of the present invention to provide a musical instrument that is durable and robust.

It is still another object of the present invention to provide a musical instrument that provides all of the above benefits and advantages.

SUMMARY OF INVENTION

In the present invention, the first object is achieved by providing a musical instrument comprising an elongated member with opposing ends on opposite sides thereof and having at least one flat face between the opposing ends; an elongated flat metal strap having a top and bottom end, the top and bottom end being connected proximal to the opposing ends of the elongated member such that the flat metal strap extends along the flat face thereof, being spaced apart there from by a gap; an adjustable means to modulate the tension of the strap between the ends thereof that are connected to the elongated member; and at least one pickup coil disposed within the elongated member to detect vibrations of the flat metal strap.

Another object is achieved by providing a musical instrument comprising: an elongated member with opposing ends, the elongated member having a width; an elongated flat strap having a top and bottom end, the top and bottom end being connected proximal to the opposing ends of the elongated member such that the flat metal strap extends along the length thereof; a means to adjust the tension of the strap between the ends thereof that is coupled to the elongated member; and at least one pickup means disposed within the elongated member to detect vibrations of the flat metal strap.

Another aspect of the invention is characterized by a process for fabricating the musical instrument, the process comprising the steps of providing a hollow elongated member having a front elongated side and a rear elongated opposite side opposite the front elongated side, the elongated member and the front and rear elongated sides terminating at a first and second end, wherein at least the first end is open; providing a flat strap having a first end and a second end; forming a first and second pair of slits in front and rear sides of the elongated member, the first pair being proximal to the first end thereof, and the second pair being proximal to the second end thereof and distal from the first end, each pair of slits of slits being a front slit in the front elongated side and a proximally disposed rear slit in the rear elongated slide; installing a tensioning means within the hollow elongated member from the first open end thereof; inserting the first and second ends of the flat strap though the first and second pairs of slits formed in the hollow elongated member, such that the first and second ends of the flat strap each enter the elongated member a the slit formed in the front elongated side and exit the elongated member at the slit formed in the rear elongated side, engaging a portion of the flat strap disposed with the interior of the elongated member proximal to the first end with the tensioning means, attaching the ends of the straps that extend beyond the rear elongated side of the elongated member to the elongated member.

The above and other objects, effects, features, and advantages of the present invention will become more apparent from the following description of the embodiments thereof taken in conjunction with the accompanying drawings.

DETAILED DESCRIPTION

Figure 1:
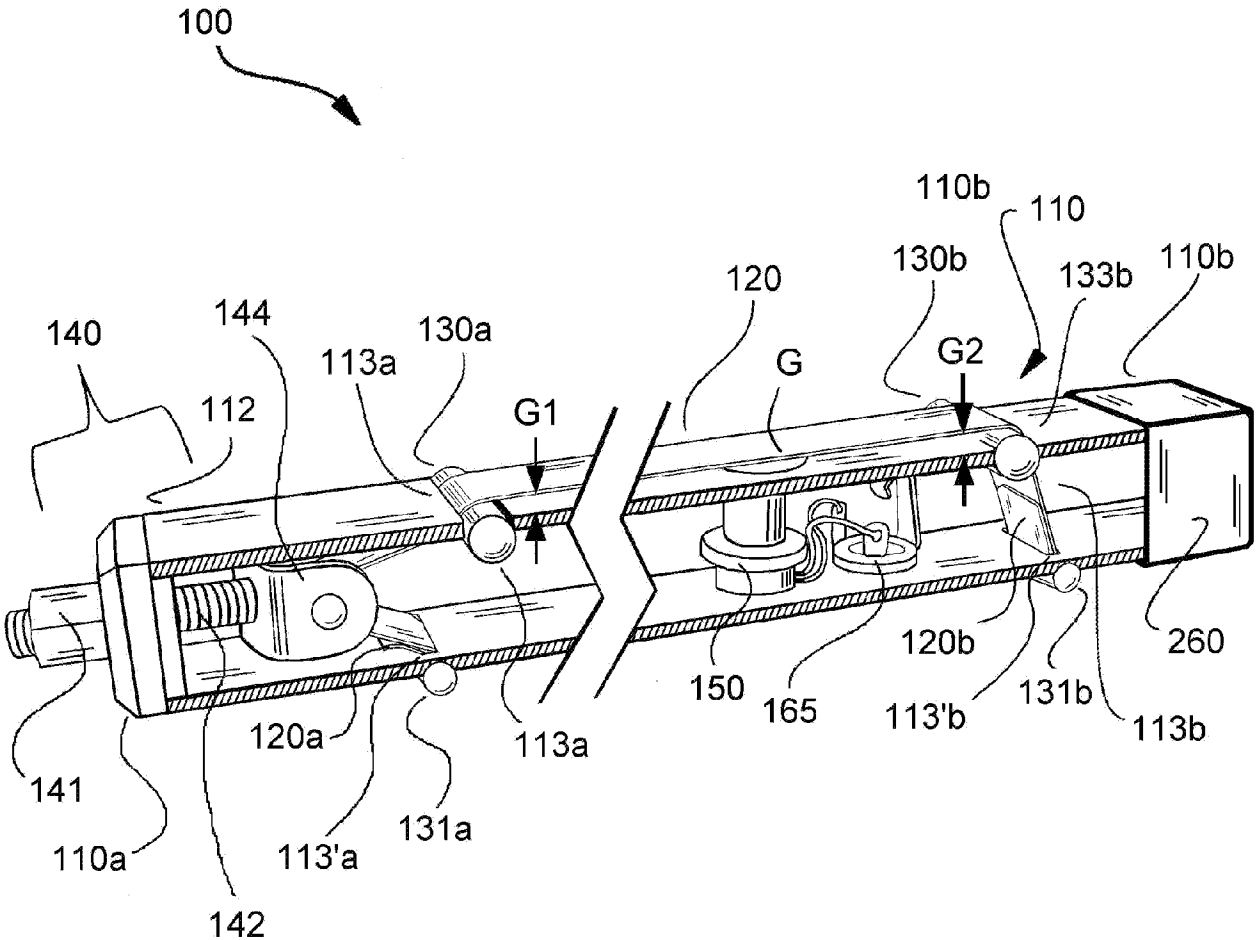
FIG. 1 is a cut away perspective view of an embodiment of the instrument showing the internal and external components thereof.
Figure 2:
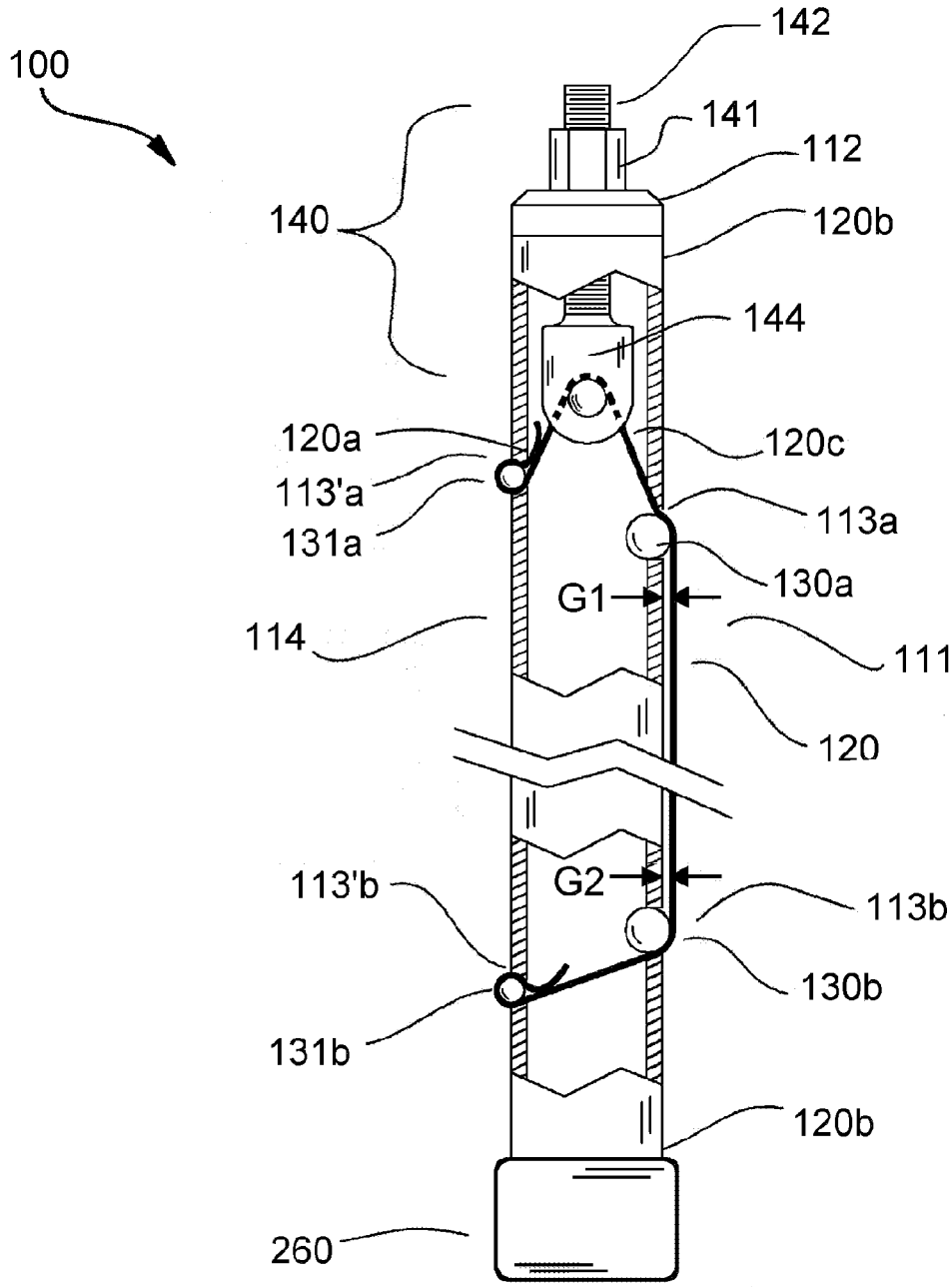
FIG. 2 is a cut-away side elevation view of the instrument of FIG. 1
Figure 3B:
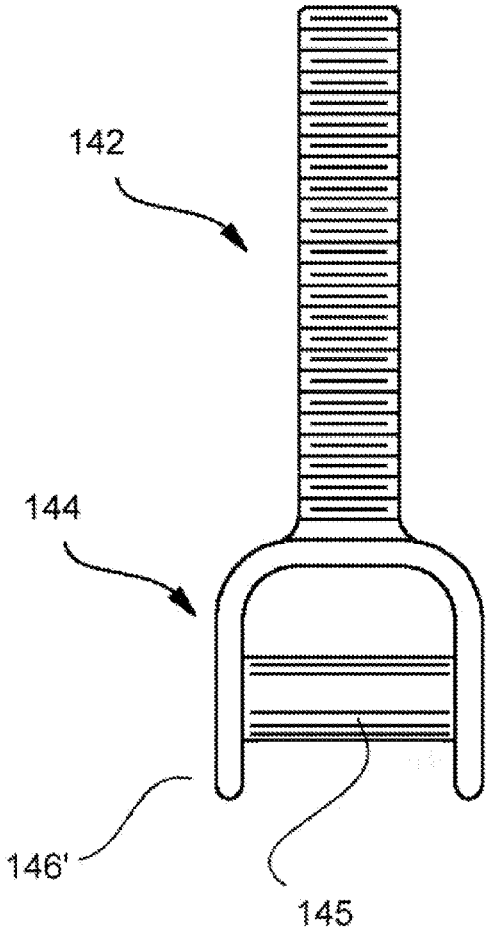
FIGS. 3A and 3B are front and side elevation views respectively a component of the tension mechanism shown in FIGS. 1 and 2.
Figure 3A:
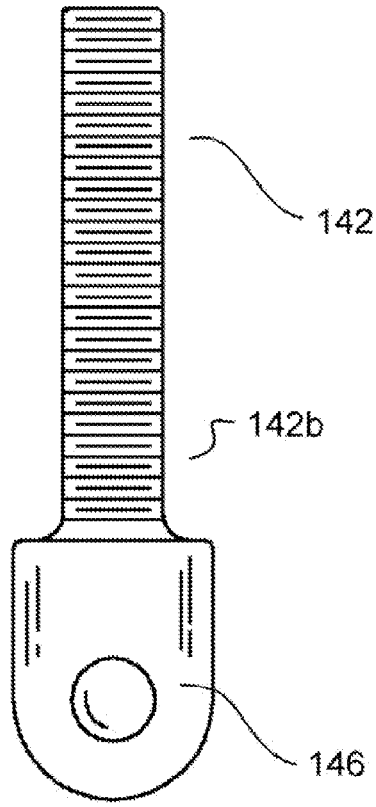
Figure 4:
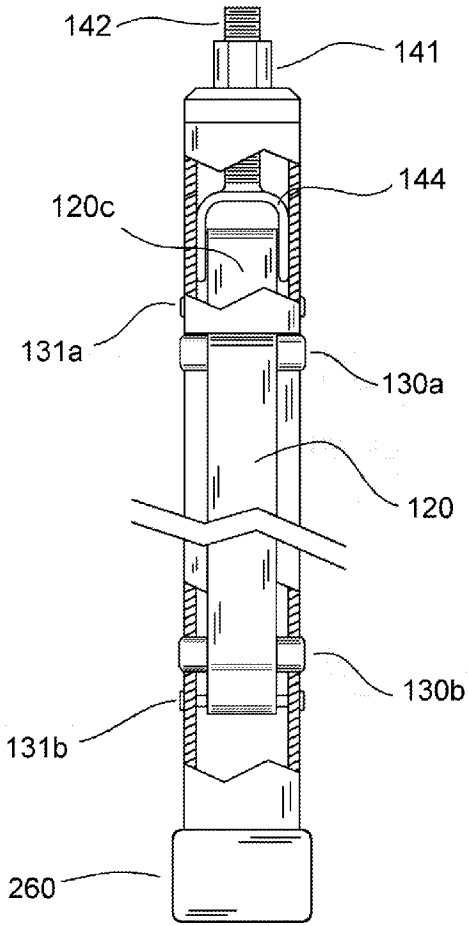
FIG. 4 is cut-away front elevation view of the instrument of FIG. 1

Referring to FIGS. 1 through 7, wherein like reference numerals refer to like components in the various views, there is illustrated therein a new and improved Electric Musical Instrument, generally denominated 100 herein.

In accordance with the present invention instrument 100 has a body that is generally an elongated member 110 preferably having at least one flat face 111 with an elongated flat strap 120 connected at opposing end thereof and tensioned to extend generally parallel to the flat face 111. It is also preferable that the tension be adjustable, as will be disclosed further below. Further, within the elongated member 110 is a transducer or vibration pick up means 150 disposed to detect vibrations of the flat strap 120, which produces a variable voltage at an output connecting port or socket 165 which makes electrical connection to the transducer 150.

While the flat strap 120 is preferably ferromagnetic for use with a transducer or vibration pick up means that is a magnetic pickup coil, piezoelectric pickups and like vibration detection means can be deployed with other forms of straps.

It was discovered that in the more preferred embodiments of instrument 100 using the magnetic pick up and ferromagnetic strap could produce a unique and pleasing sound, yet was easy to play. Further, deploying the preferred material of construction, the instrument was also durable and robust. Instrument 100 also enables a musician to deploy a number of creative modalities. For examples, as the strap 120 floats just above the length of the body 120, it can be 'fretted' like a stand-up bass. However, rather than strumming, the strap can also be struck against the elongated member with one or two hands. It can even be bowed like a violin, with two hand tapping, hand and stick, and with bending of the instrument body to create a vibrato effect. Further, the instrument can be played upright, or nearly vertical like a stand-up bass, or placed horizontally with the strap upright for playing like drums or other percussion instruments. By deploying various means to tension strap 120 the instrument 100 can be open tuned to almost any key.

It should be appreciated that the elongated member and strap dimension can be varied from the preferred embodiment disclosed herein to provide a wide range of acoustic outputs, as well as accommodate a range of playing styles by musicians. As such, the preferred ranges for other parameters are likely to change accordingly. For example, in the case of an instrument having a length of having a length of about 50 to 60 inches it was particularly discovered utilizing a magnetic pick up and a ferromagnetic strap 120 that a small gap of 0.020" along the full length created a problem with the strap buzzing against the flat face the elongated member that deployed the magnetic pickup. Although a larger gap of 0.010" along the full length made the instrument sound much better, having eliminated the buzz, it was harder to play the instrument with such a small gap. Hence, it was then discovered that it is preferable to vary gap G along the length of the instrument to provide a tapered gap, with the wider gap near the transducer end opposite where the strap 120 would come in contact with the musician's hand(s) or another implement held in their hands. Thus, while it is still generally preferably to tap this portion of the strap 120, the optimum gap dimension are likely to vary with the strap 120 and elongated member length, as well as the strap 120 width. The preferred means to provide such a tapered gap is to attach opposing ends 120*a* and 120*b* of the strap 120 to the elongated members by a single fold or wrap over a cylinder shaped spacing nuts 130*a* and 130*b*, each of which is seated in a matching depression 133*a*/133*b* on the flat face 111. Alternatively, cylindrical spacing nut 130*a* and 130*b* can be seated within a wide slit 113*a*/133*b* that accommodates the strap thickness, but has a slit width that is less than the combined thickness of the strap and spacing nut diameter. It should also be appreciated that while the elongated member provides rigid extremities for supporting the end of the strap 120 under tension, as well as for disposing the vibration detection means close to the strap 120, the shape and outer surface of the elongated member can vary between these positions for aesthetics or greater user comfort, depending on how the instrument is either held or supported so that the face closest to the strap 120 need not be planar or flat. However, manufacturing the instrument from an elongated member having at least one flat face for placement adjacent to the strap 120 simplifies the placement of the vibration detection means at an optimum position from the strap 120 in manufacturing.

Further, in accord with deploying an elongated member having a flat face for this purpose, the diameter of the spacing nuts, and more specifically their projection above front face 111, can set the gap thickness at the opposing ends of the elongated member 110. Thus, the cylindrical spacing nuts (130*a*, 130*b*) are also preferably disposed external and perpendicular to the elongated member 110. Most preferably, the gap, G between the strap 120 and the front face is tapered by the diameter of the upper and lower spacing nuts such that the gap a the top G1 is about 0.02 inches (0.5 mm) and the gap at the bottom, G2, is about 0.1 inches (2.5 mm). It was discovered that a tighter gap tolerance of 0.02" allowed the strap 120 to be manipulated with minimum effort in an upper portion of the elongated member 110 proximal to end 110*a*, comparable to a fingerboard on other string instruments. Rather than using different diameter spacing nuts, it is more preferably that the depths of the concave depressions that seat the spacing nuts 130*a* and 130*b* set the gap thickness. Thus, when both spacing nuts are the same diameter (0.375") and their respective concave slots are preferably machined at different depths to achieve the 0.020" and 0.100" gap thicknesses.

It should also be appreciated that the larger gap (0.10") at bottom allows the strap 120 to be further from the body in the lower area around the pickup. Hence, the variable gap provides the easiest play-ability without the buzzing effect. The 0.02" to 0.1" taper in the air gap was the result of multiple experiments, in which it was also discovered that pickup 150 is preferably ⅕ of the strap 120 span from the bottom, with strap 120 having a length of about 50 to 60 inches (127-152 cm). More generally, in various other embodiments, the strap can be about 80-90% of the length of the elongated member 110. However, the pick-up 150 but can be placed elsewhere when applying the above principles should the gap have a different taper or the instrument a different length.

A preferred strap 120 is a solid steel ferromagnetic strap about ¾-inches (19 mm) wide by 0.025" (0.64 mm). It should be noted that steel strap, because of its shape, can only vibrate in one plane, as opposed to a string, which vibrates in all directions regardless of how it's plucked. It should be appreciated that the ferromagnetic strap 120 while preferably solid metal, such as iron and nickel, can be alternatively clad or laminated metal or a non-metal strap having a metal coating or lamination or impregnation with ferromagnetic layers, sheets or wires. Generally the width of the strap is at least 60% width of the front flat face 111 of the elongated member 110.

It should be appreciated that the cross-sectional shape of the elongated member 110 is alternatively a square, I-beam, triangle. Any shape is possible, but most preferably the elongated member 110 has at least one flat elongated front face that is generally, but need not be precisely parallel to strap 120. The cross-section shape of elongated member 110 need not be of constant shape along its length, as it is can be optionally shaped for additional user comfort, aesthetic style and the like. In one embodiment, the elongated member 110 is preferably a hollow metal (aluminum) shaft or rod, and most preferably the elongated member 110 is a rigid square shaped tubular body of anodized 6061 alloy aluminum with a square cross section of about 1¼" by 1¼" (32 mm×32 mm) by about 65-inches (165 cm) long. However, in other embodiment the strap can vary from about 12 to about 70 inches long, or more, and the elongated member 110 can be from about 1¼ in. to about 2 in. wide.

As shown in various Figures, a rubber boot 260 is preferably connected to the lower end 110*b* of elongated member 110 to protect it in use when supported on the ground and provide frictional support to prevent lateral sliding on a supporting surface.

The ends 120*a* and 120*b* of the strap 120 are optionally coupled to the elongated member 110 in various ways. A preferred means for this terminal connection of the flat metal strap to the elongated member 110 is achieved after first the strap 120 passing over spacers 130*a* and 130*b* is so a the ends enter the center of member 110. The ends or terminal portions 120*a* and 120*b* of the strap 120 can then extend outward from the back face through rear slits 113'*a* and 113' formed in the back of the hollow square rod shown in FIG. 1.

In more preferred embodiments shown in FIGS. 1, 2, 4 and 5, each of the opposing terminal portion 120*a* and 120*b* of the strap exit the elongated member 110 through the back face slits 113'*a* and 113'*b* respectively, and then extend over engaging cylindrical nuts 131*a* and 131*b*. Thereafter they reenter the interior of the elongated member 110 via the same back side slit. Friction between the engaging cylinder surfaces 131*a*/131*b* and the strap portions 120*a* and 120*b* in contact therewith prevent the strap 120 from becoming loose. In this embodiment it is preferable to seat the rear cylindrical engaging nuts 131*a* and 131*b* in a concave depression on the rear face 114, which forces the cylinder to center itself over the slit when the strap 120 is tensioned. Most importantly, the concave surface creates more surface area to 'pinch' the strap between the cylinders 131*a/b* and elongated member 110.

Figure 5:
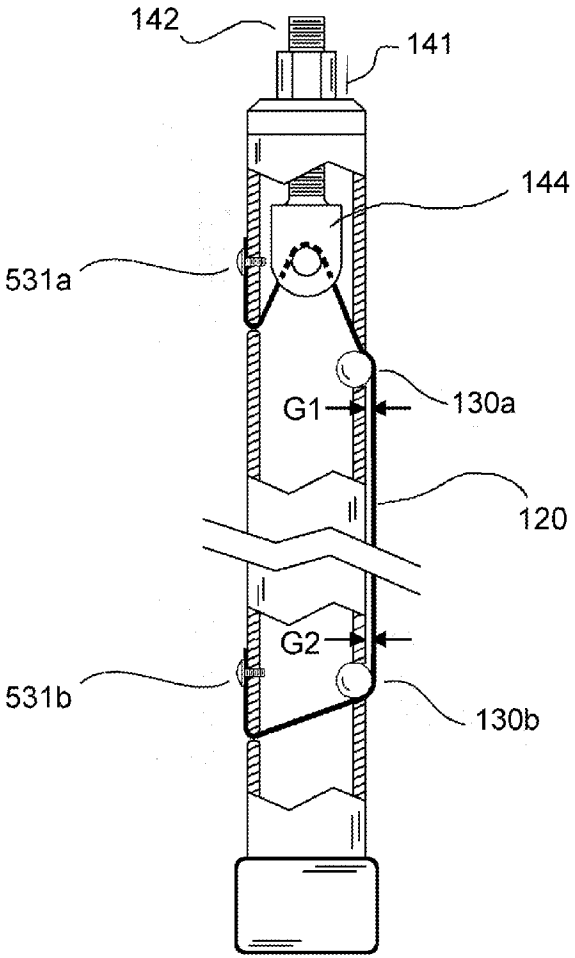
FIG. 5 is a cut-away and sectional side elevation view showing an alternate method of strap connection.
Figure 6:
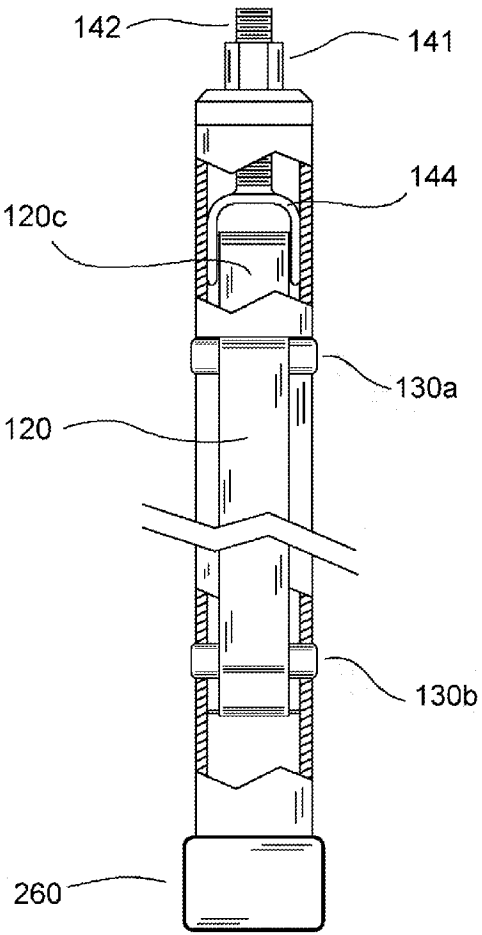
FIG. 6 is a cut-away front elevation view showing the alternate method of strap connection.
Figure 7:
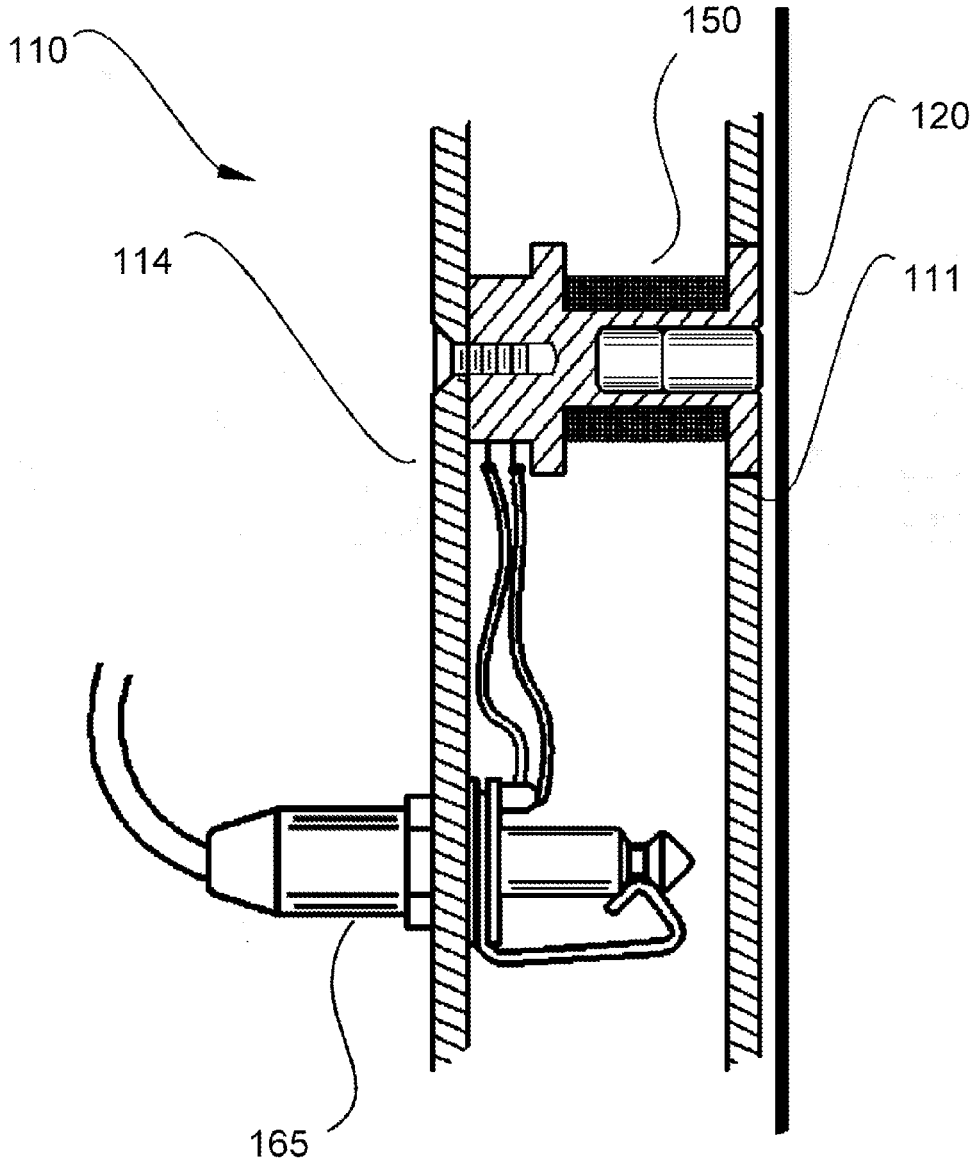
FIG. 7 is a cross sectional side elevation of a lower portion of the instrument in FIGS. 1-6 to show the installed pickup and the external electrical connection thereto.

In another embodiment, the terminal portions 120*a* and 120*b* of strap 120 that extend through the back via slits 113'*a/b* are attached directly to the back of the elongated member 110 as in FIG. 5 with screws 531*a* and 531*b*.

Further, as shown in FIGS. 1-6, the adjustable tensioning means 140 is preferably a threaded tensioning nut 141 that engages a threaded bolt 142 external to the end cap 112 (which can seal an otherwise open top end 110*a* of the elongated member 110). The opposite end 142*b* of the threaded bolt 142 terminates in a connection to the crown of a shackle 144 with a portion 120*c* of the strap 120 that extends between a front 113*a* and back 113'*a* slit extending around the shank of the shackle pin 145 (or shackle bolt), transversely spans between arms 146 and 146' of the crown shackle 144. Thus, the upward movement of the shackle pin 145 via the handle 142 tensions the strap 120. Tensioning the strap, such as via the nut 140, or any alternative means increases the frictional engagement of the strap 120 to the rear engaging or locking cylindrical nuts 131*a* and 131*b*.

An alternative tensioning means for strap 120 is to wrap and attach one end to a turning peg secured externally to the elongated member 110 proximal to the top 110*a*, or bottom 110*b*.

Another aspect of the invention is a method of forming instrument 100 using a hollow elongated member 110. The slits 113*a* and 113*b* formed in the front face 111 and slits 113'*a* and 113*b* are formed in the rear face 114 of member 110. The strap ends 120*a* and 120*b* are inserted through the slit pairs 113*a*/113'*a* and 113*b*/113'*b*. The tensioning means is installed in the top 110*a* to engage a portion of strap 120 proximal to end 120*a* inside the elongated hollow member 110, and then the ends 120*a* and 120*b* of the strap are secured to the elongated hollow member 110, either externally as shown in FIG. 5, or internally via frictional engagement with cylinders 131*a/b* as described above.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

The invention claimed is:

1. A musical instrument comprising:

a) an elongated member with opposing ends on opposite sides thereof and having at least one flat face between the opposing ends;

b) an elongated flat metal strap having a top and bottom end, the top and bottom end being connected proximal to the opposing ends of the elongated member such that the flat metal strap extends along the flat face thereof, being spaced apart there from by a gap, c) an adjustable means to modulate the tension of the strap between the ends thereof that are connected to the elongated member, and d) at least one pickup coil disposed within the elongated member to detect vibrations of the flat metal strap.

2. A musical instrument according to claim 1 wherein the adjustable means to modulate the tension of the strap is a threaded bolt that engages a threaded handle external to a top of the elongated member, wherein rotation of the threaded bolt displaces the threaded handle within the elongated member and a crown shackle attached thereto, the crown shackle being attached to a shackle pin that supports a portion of the elongated member whereby the corresponding displacement of the shackle pin modulates the tension on the elongated member.

3. A musical instrument according to claim 2 wherein the portion of the elongated flat metal strap that is attached to the shackle pin extended into the elongated member through a slit formed in the at least one flat face thereof.

4. A musical instrument according to claim 3 wherein a portion of the elongated flat metal strap that extends into the elongated member extends around a shank of the shackle pin with the top end thereof extending past the shackle pin and being attached to a rear face of the elongated member, the rear face being opposite the flat face.

5. A musical instrument according to claim 1 in which the flat metal strap is spaced away from the flat face of the elongated member by spacing nuts.

6. A musical instrument according to claim 5 in which the proximal and distal portion of the flat metal strap between the top and bottom ends thereof each extend around a spacing nut, wherein each spacing nut is seated in a depression formed in the flat face of the elongated member.

7. A musical instrument according to claim 6 in which the portions of the flat metal strap that extend beyond each spacing nut then extend into the front face of the elongated member through slits formed therein, wherein the top and bottom ends of the elongated member then exit a rear face of the elongated member, the rear face being opposite the flat face.

8. A musical instrument according to claim 7 wherein the top and bottom ends of the elongated member that exit the rear face of the elongated member via slit formed therein and are attached to the elongated member by locking cylindrical nuts disposed on the rear face.

9. A musical instrument according to claim 1 wherein the gap is tapered to varying in thickness between opposite ends of the elongated member.

10. A musical instrument according to claim 9 in which the flat metal strap is spaced away from the flat face of the elongated member by a spacing nuts means, in which the spacing nuts have different diameters.

11. A musical instrument according to claim 9 in which the pickup coil is disposed closer to the end of the elongated flat metal strap that is with a larger distance from the flat face of the elongated member.

12. A process for fabricating a musical instrument according to claim 1, the process comprising the steps of:

a) providing a hollow elongated member having a front elongated side and a rear elongated opposite side opposite the front elongated side, the elongated member and the front and rear elongated sides terminating at a first and second end, wherein at least the first end is open, b) providing a flat strap having a first end and a second end, c) forming a first and second pair of slits in front and rear sides of the elongated member, the first pair being proximal to the first end thereof, and the second pair being proximal to the second end thereof and distal from the first end, each pair of slits of slits being a front slit in the front elongated side and a proximally disposed rear slit in the rear elongated slide, d) installing a tensioning means within the hollow elongated member from the first open end thereof, e) inserting the first and second ends of the flat strap though the first and second pairs of slits formed in the hollow elongated member, such that the first and second ends of the flat strap each enter the elongated member a the slit formed in the front elongated side and exit the elongated member at the slit formed in the rear elongated side, f) engaging a portion of the flat strap disposed with the interior of the elongated member proximal to the first end with the tensioning means, g) attaching the ends of the straps that extend beyond the rear elongated side of the elongated member to the elongated member.

13. A musical instrument comprising:

a) an elongated member with opposing ends, the elongated member having a width, b) an elongated flat strap having a top and bottom end, the top and bottom end being connected proximal to the opposing ends of the elongated member such that the flat strap extends along the length thereof, c) a means to adjust the tension of the strap between the ends thereof that is coupled to the elongated member, and d) at least one pickup means disposed within the elongated member to detect vibrations of the flat metal strap.

14. A musical instrument according to claim 13 wherein the at least one pickup means is at least one of a magnetic pickup coil and a piezoelectric pickup.

15. A musical instrument according to claim 13 wherein the width of the elongated member is substantially constant and the elongated flat strap has a width that is at least 60% of the width of the elongated member.

16. A musical instrument according to claim 13 wherein the cross-sectional shape of the elongated member is selected from the group consisting of a square, a rectangle, an I-beam and a triangle.

17. A musical instrument according to claim 13 wherein the strap comprises ferromagnetic material and the at least one pickup means is a magnetic pickup coil.

18. A musical instrument according to claim 13 in which the flat strap is spaced away from the elongated member by spacing nuts.

19. A musical instrument according to claim 13 wherein the elongated member is a square hollow rod.

20. A musical instrument according to claim 19 wherein the strap is retained within the interior of the elongated member via slots forming in a face thereof.

* * * * *